United States Patent [19]

Schilling et al.

[11] 4,083,556

[45] Apr. 11, 1978

[54] SHEET DELIVERY FOR ROTARY PRINTING MACHINES

[75] Inventors: Paul Schilling, Neckargemund; Gerhard Pollich, Heidelberg, both of Germany

[73] Assignee: Heidelberger Druckmaschinen Aktiengesellschaft, Heidelberg, Germany

[21] Appl. No.: 744,459

[22] Filed: Nov. 24, 1976

[30] Foreign Application Priority Data

Nov. 26, 1975 Germany ..... 2552998

[51] Int. Cl.[2] ..... B65H 29/04

[52] U.S. Cl. ..... 271/204

[58] Field of Search ..... 271/204, 205, 206, 182, 271/183

[56] References Cited

U.S. PATENT DOCUMENTS

| | | | |
|---|---|---|---|
| 3,167,012 | 1/1965 | Claybourn | 271/204 X |
| 3,391,928 | 7/1968 | Mowry | 271/204 X |

FOREIGN PATENT DOCUMENTS

| | | | |
|---|---|---|---|
| 513,206 | 10/1939 | United Kingdom | 271/204 |

*Primary Examiner*—Richard A. Schacher
*Attorney, Agent, or Firm*—Herbert L. Lerner

[57] ABSTRACT

Sheet delivery for rotary printing machines having gripper bridges carried by revolving endless chains traveling along a chain path having a straight and ascending section merging with a section of the path extending horizontally across a delivery pile, includes means defining a sheet guide path having a curvilinear configuration spaced at a continuously varying distance from the endless chains and disposed below the straight and ascending section of the chain path.

7 Claims, 7 Drawing Figures

SHEET DELIVERY FOR ROTARY PRINTING MACHINES

The invention relates to a sheet delivery for rotary printing machines with gripper bridges revolving on endless chains, a section of the chain path extending straight and rising until it merges into a section of the chain path extending horizontally across the delivery pile.

In German Pat. No. DL-PS 110,472, a sheet delivery for a sheet-fed printing machine is described, the chain path of the sheet delivery having a straight ascending or sloping section which merges into a section extending horizontally above the delivery pile. Below the straight ascending section of the chain path, a trough is provided which has a surface that is uniformly spaced from the chain guide means. An air cushion is formed by the trough below the sheet transported by the gripper bridges of the revolving chain, by means of which, set-off or smearing of the freshly printed underside of the sheet is sought to be avoided during perfector printing.

Since the trough is of planar construction and extends equidistantly from the chain guide means, the transported sheet is also moved virtually in a planar fashion or flatly across the trough. Consequently, the stiffness or rigidity of the sheet when subjected to a loading perpendicularly to the surface thereof is minimal. Fluttering movements therefore inevitably occur due to air turbulence at high speeds. Set-off or smearing problems consequently arise because the last or trailing one-third portion of the sheet is not gripped properly by the braking devices that are disposed immediately forward i.e. upstream, of the delivery pile. But it is just this portion of the sheet which the sheet braking device is meant to act upon.

Instead of being braked, however, a fluttering sheet strikes the front stops of the delivery pile at virtually unreduced speed, whereby the forward or leading edge of the sheet is damaged or the sheet is not deposited flatly.

It is accordingly an object of the invention to provide a sheet delivery for rotary printing machines wherein the sheet moved by the chain in the ascending inclined section is stabilized by the simplest means without the action of external air, so that it is also gripped reliably by the braking device in the rear or trailing one-third portion of the length thereof and is braked without forming folds or creases.

It is a further object of the invention to provide such a sheet delivery that achieves reliable and gently delivery and deposition of sheets printed on one or both sides thereof on the delivery pile at high printing speeds and by relatively simple means.

With the foregoing and other objects in view, there is provided, in accordance with the invention, a sheet delivery for rotary printing machines having gripper bridges carried by revolving endless chains traveling along a chain path having a straight and ascending section merging with a section of the path extending horizontally across a delivery pile, comprising means defining a sheet guide path having a curvilinear configuration spaced at a continuously varying distance from the endless chains and disposed below the straight and ascending section of the chain path. In other words, the configuration of the sheet guide path is other than being equidistant from the chain path.

The curved configuration of the sheet guide path which differs from the configuration of the chain guidance stabilizes the sheet and constrains it to a long wavy movement that is coordinated in a simple manner so that the rear or trailing end of the sheet is positively or necessarily drawn across the braking device. Experience has shown that relatively thin sheets tend to flutter at very high printing speeds. The curved configuration of the guide path constrains even such sheets to a kind of "long harmonic", however, so that the sheets undergo a lateral stabilization. Uncontrolled fluttering is prevented. The residual shorter wavy movement of the thin sheet remains, however, of such an order of magnitude that the end region thereof is reliably deposited upon the braking device.

In perfector printing, it is advantageous, from the standpoint of set-off or smearing of the underside of the sheet, if only a few narrow braking devices, such as brake rollers, for example, and sheet guide means adjustable across the width of the sheet are used. Thinner sheets then tend, however, to sag between the sheet guide means or the braking rollers and to develop longitudinal creases or folds, which markedly increases the longitudinal stability of the sheet. This greater longitudinal stability causes the sheet end to fly up prematurely at the location of transition from the straight ascending section to the horizontally extending section of the chain path, so that the braking device cannot take effect. The effect of an undesirably increasing longitudinal stability of the sheet is consequently the same as in the case of excessive fluttering of the sheet end. The sheet is not adequately braked. Furthermore, sheets sagging between the sheet guide means tend to form creases or folds in the sheet transport direction when they are drawn by the gripper bridges across the transition location into the horizontal path section. The operation of the braking device is thereby impaired.

It is advantageous for optimal guidance of the endless chain, if the ascending straight section merges with comparatively great curvature into the horizontal section, so that sufficiently large working space remains for the last printing unit of a printing machine for a shortest possible chain length, and, moreover, space can also be provided within the endless chain path for various appliances, such as powder units, radiant dryers and the like. A correspondingly great curvature of the sheet guide path at the transition location would, however, promote the premature upswing of the sheet end. For this reason, in accordance with another feature of the invention, wherein the straight and ascending section and the horizontal section of the chain path merge at a transition location, and the sheet guide path has a generally ascending section adjacent the straight and ascending section of the chain path, a generally horizontal section adjacent the horizontal section of the chain path, and a transition location between the generally straight and ascending and the generally horizontal sections of the sheet guide path, the transition location of the sheet guide path having a lesser curvature than that of the transition location of the chain path.

In accordance with a further feature of the invention, the sheet delivery is in combination with a rotary printing machine having at least one printing unit including an impression cylinder, and the revolving endless chains are looped about reversing pulleys at the lower end of the straight and ascending section of the chain path, the reversing pulleys being disposed adjacent the impression cylinder, the sheet guide path being in the form of a flat sinusoidal curve spaced closest to the endless chains at a first location in proximity of the chain reversing pulleys and at a second location adjacent the straight and ascending section of the chain path and close to the transition location at which the straight and ascending section and the horizontal section of the chain path merge.

The sheet is thereby constrained into a curved or wavy path immediately after it is taken over by the gripper bridges. It is quite impossible for any uncontrolled fluttering to occur. It is also advantageous that the wave trough lies in the middle region of the straight ascending section. The sheet transported at high printing speeds thereby has the opportunity to execute the most favorable wave movement in accordance with the air resistance.

In accordance with additional alternate features of the invention, the means defining the sheet guide path comprise guide straps, adjustable bands or a plurality of rows of narrow guide wheels. Furthermore, the means defining the sheet guide path may be constructed as a guide plate extending across the entire width of the sheet guide path, a construction that is particularly suitable for perfector printing. The sheet transported across the curved guide plate forms an air cushion beneath itself which is strong enough or so intensified by the curvature that set-off or smearing is, in fact, prevented in the transition region of the straight sections.

As stated hereinbefore, German Pat. No. DL-PS 110,472 discloses a sheet delivery wherein a trough is provided beneath the straight ascending section of the chain guide means. This trough is of absolutely planar construction and extends parallel to the chain guide means. Due to this construction, contact between the sheet underside and the trough surface can occur in two cases: firstly, if the sheet end flutters at high sheet travel speed and, secondly, if the sheet taken over from the impression cylinder is guided around the chain reversing pulleys and the end thereof strikes the edge of the trough before an air cushion can develop.

So that the sheet taken over by the gripper bridges cannot strike against the edge of the guide plate, and so that an air cushion is formed without delay immediately after the take-over of the sheet, there is provided, in accordance with yet another feature of the invention, a sheet delivery wherein the guide plate has an end thereof partly surrounding the reversing pulleys and located in immediate proximity of a sheet transfer location between the impression cylinder and the respective gripper bridges carried by the endless chains, the end of the guide plate having a shape continuously receding from the periphery of the reversing pulleys.

In accordance with a contomitant feature of the invention, the end of the guide plate has a spirally widening shape.

Other features which are considered as characteristic for the invention are set forth in the appended claims.

Although the invention is illustrated and described herein as embodied in a sheet delivery for rotary printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
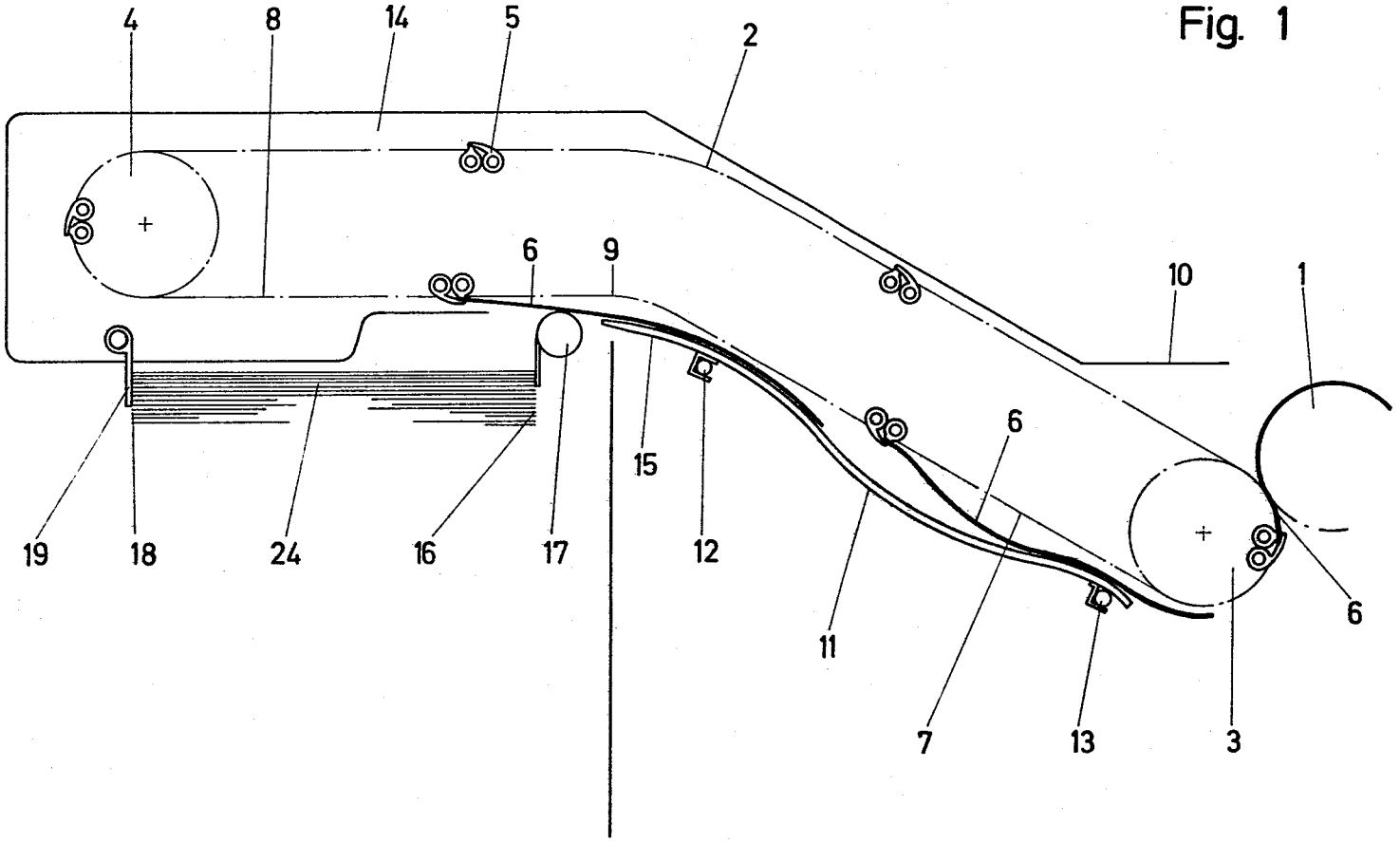
FIG. 1 is a diagrammatic side elevational view of a sheet delivery with curved guide straps.
Figure 5:
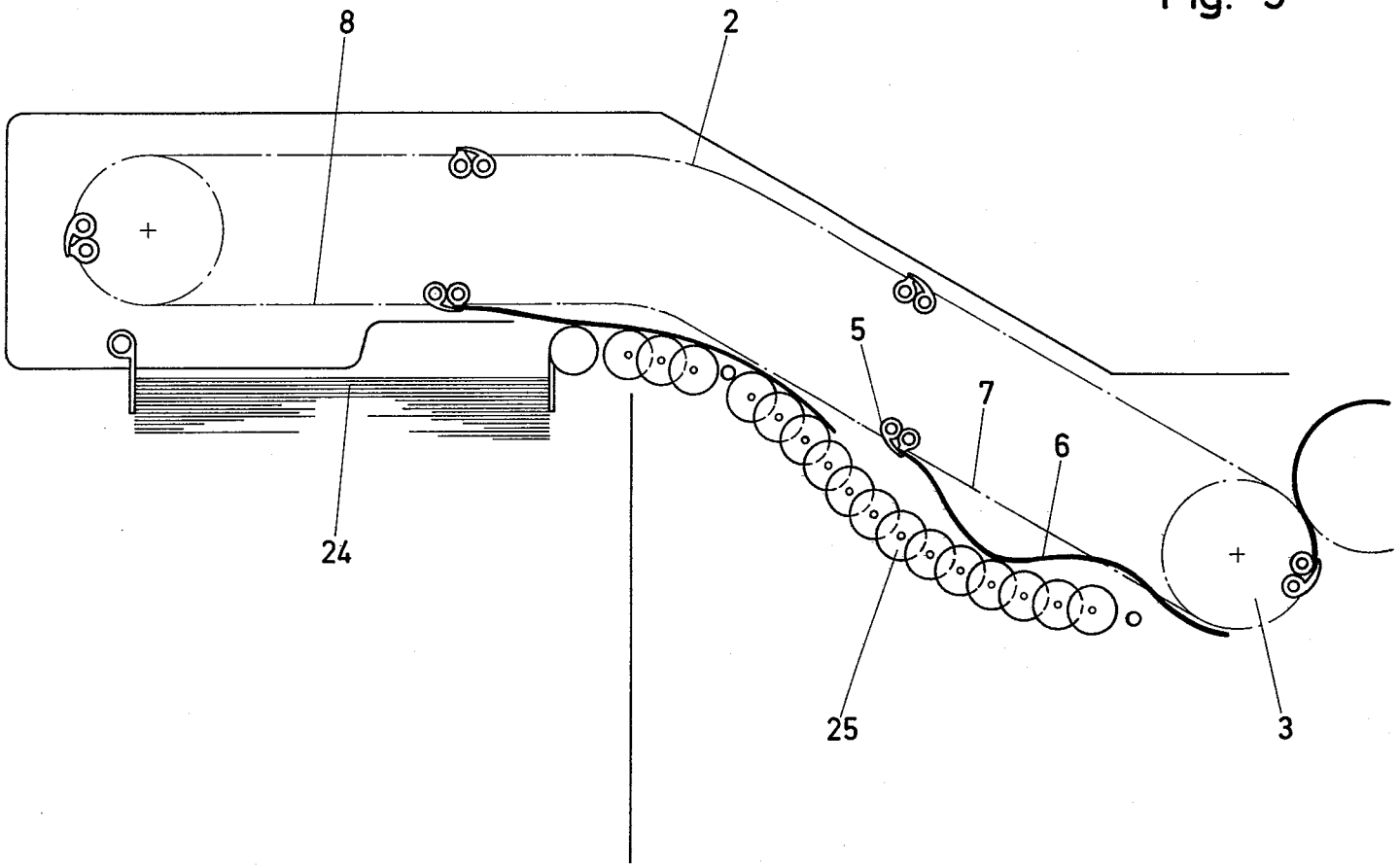
FIG. 5 is a view similar to that of FIG. 1 of yet another embodiment of the sheet delivery wherein the sheet guide path is formed of a plurality of rows of narrow guide wheels.
Figure 6:
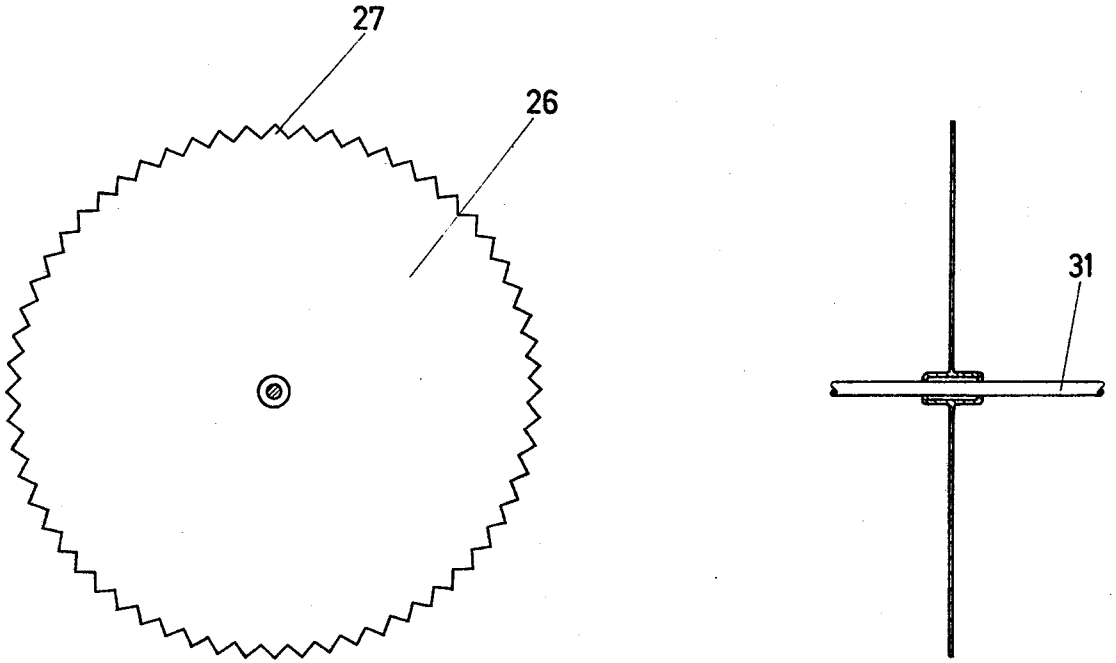
Figure 7:
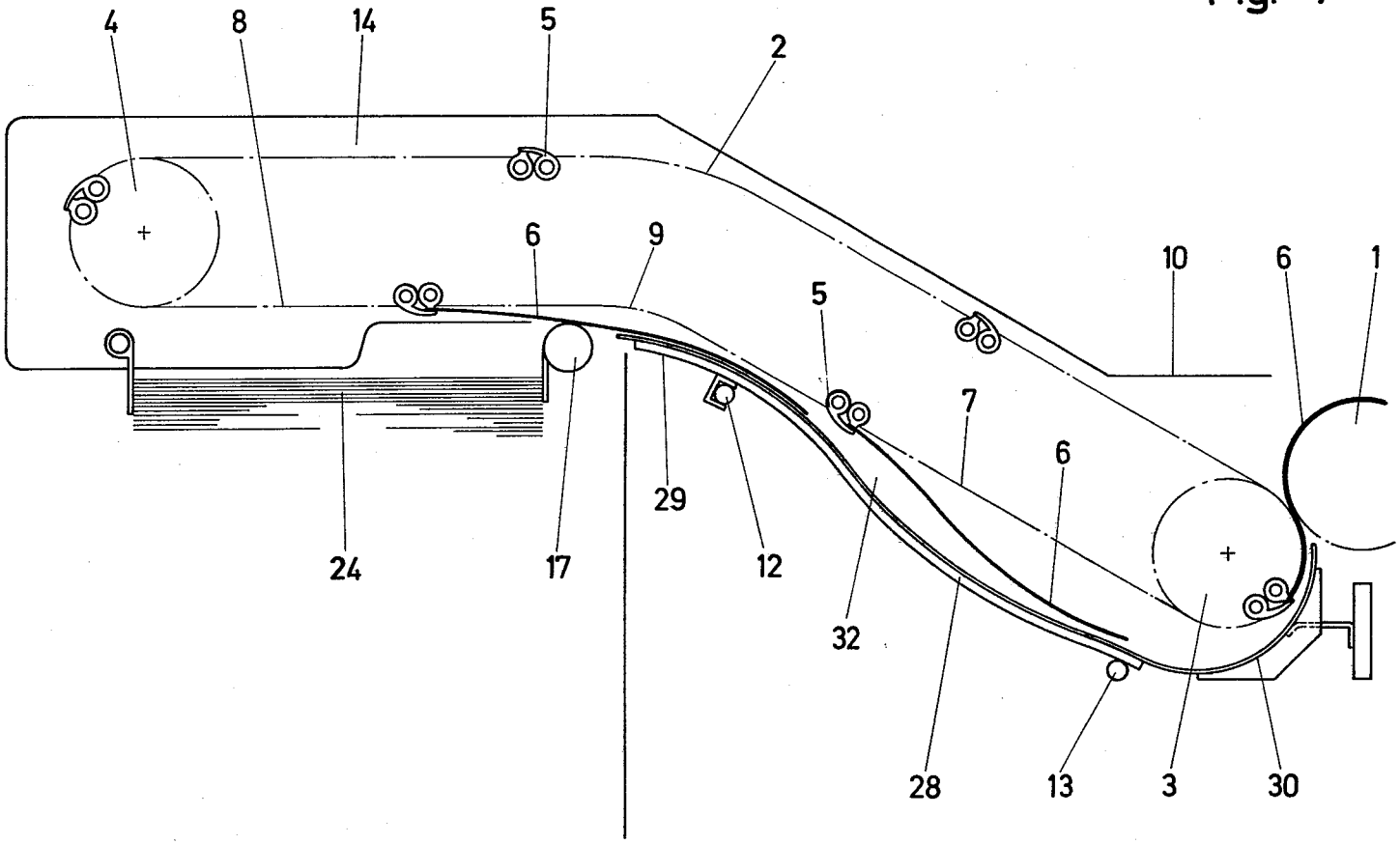

FIGS. 6*a* and 6*b* are much-enlarged front and side views, respectively, of one of the guide wheels of FIG. 5; and FIG. 7 is a view similar to that of FIG. 1 of an additional embodiment of the sheet delivery wherein the sheet guide path is constructed as a guide plate.

Figure 2:
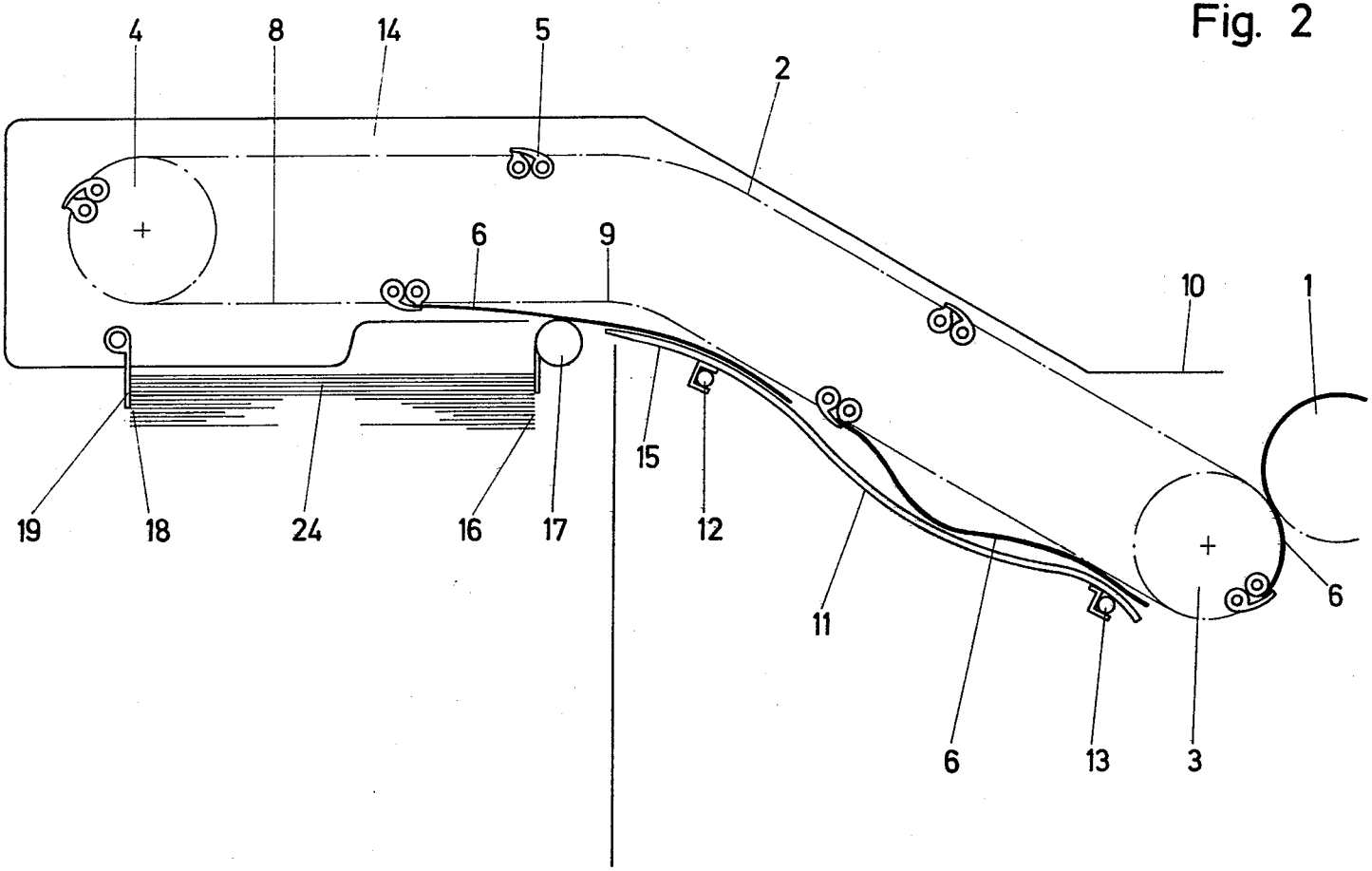
FIG. 2 is another view of FIG. 1 showing the sheet delivery during operation thereof at high printing speed.
Figure 3:
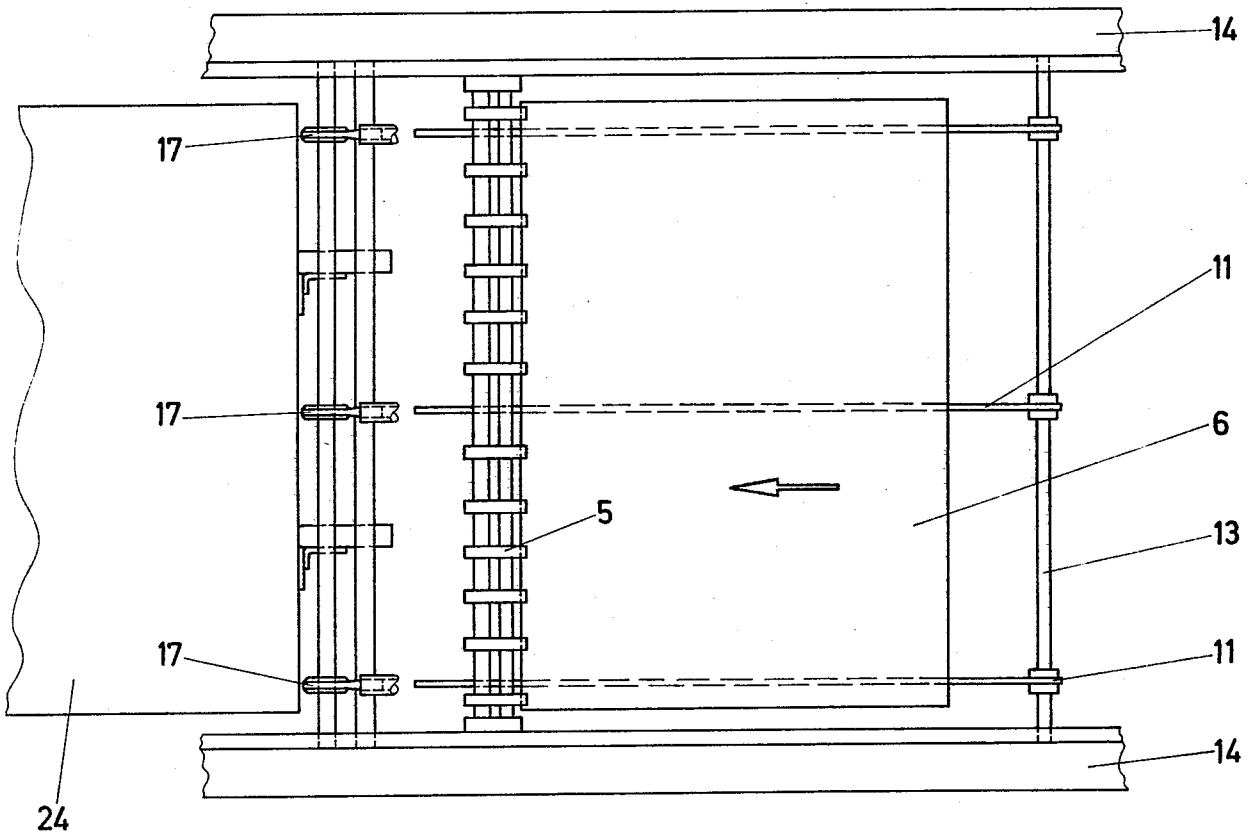
FIG. 3 is a fragmentary top plan view of FIG. 1.

Referring now to the drawing and first, particularly, to FIGS. 1 to 3 thereof, it is noted that the embodiment of the sheet delivery system shown therein follows the last printing unit of a multicolor sheet-fed rotary printing press, only the impression cylinder 1 of that printing unit being shown diagrammatically in FIGS. 1 and 2. The sheet delivery essentially includes an endless chain 2, which is guided, at one end of the sheet delivery, over chain reversing or guide pulleys 3 at the impression cylinder 1 and over chain reversing or guide pulleys 4 at the other end of the sheet delivery. A plurality of gripper bridges 5 are fastened on the chain 2 at equally spaced locations from one another, and respectively accept or take possession of a sheet 6 from the impression cylinder 1 and feed it to a delivery pile 24. The chain 2 extends along a path formed of an ascending or sloping straight section 7 and a horizontally extending section 8. The ascending straight section 7 has a lower chain path that merges with relatively large curvature into the horizontal section 8 at a transition location 9. This has the advantage that the ascending straight section 7 can be made relatively short without unduly restricting the operating or servicing space 10 behind the last printing unit represented by the impression of cylinder 1. The chain 2 as a whole must be guided in the vicinity of the last printing unit in such a manner that space will be available between the upper and lower chain paths for auxiliary appliances, such as a powder unit and drying devices.

A sheet guide path is provided in the form of a plurality of guide straps 11 located below the straight ascending section 7 of the chain 2. The guide straps 11 have the shape of a flat sinusoidal curve. They are fastened with lateral adjustability at both their ends to crossmembers or crosstie bars 12 and 13. The crossmembers 12 and 13 are, in turn, firmly attached by the ends thereof to side walls 14 of the sheet delivery.

The curved development of the guide straps 11 is such that they are closest at both ends thereof to the inclined section 7 of the chain 2,, whereas in the middle region thereof i.e. the wave trough portion thereof, they are farthest from the chain 2. The upper end 15 of the guide straps 11, as viewed in FIG. 1 for example, terminates just in front of the braking rollers 17 mounted immediately in front of i.e. upstream of, the rear edge 16 of the delivery pile 24, considered in travel direction of the sheets 6. The upper end 15 of the guide straps 11 exhibits a markedly lesser curvature than that of the straps 11 at the transition location 9 between the straight ascending, inclined section 7 and the horizontally extending section 8 of the chain 2. The curvature of the end 15 of the guide straps 11 is maintained in such a manner that, at all sheet transport speeds, the rear or tailing one-third portion of the sheet 6 is always spread out closely onto the guide straps 11, so that, due to the curvature of the sheet 6, the latter is reliably drawn in planar fashion i.e. flatly, across the braking rollers 17 even at high sheet transport speeds. As is apparent from FIG. 3, three braking rollers 17 are provided which are distributed across the width of the sheet delivery. A guide strap 11 is mounted in front or upstream of each of the braking rollers 17. Both the braking rollers 17 as well as the guide straps 11 can be adjusted or shifted laterally so that they come into contact exclusively with unprinted areas of the sheet when the printing press is practising perfector printing.

FIG. 1 shows the sheet delivery operating with a medium sheet transport speed of approximately 5,000 sheets per hour. At such a transport speed, the sheets 6 still tend yet to spread out or deposit snugly onto the sheet guide straps 11. Only when, the sheet transport speed, for example, approaches the rate of 10,000 printings per hour, do thinner sheets 6 form a shorter wave in the middle section of the guide straps 11 i.e. in the wave trough, due to the greater air resistance. The wave formation, nevertheless, occurs under such control that the sheet is stable in the lateral direction and the rear or trailing end thereof does not flutter uncontrollably. In any event, the wave formation of the sheet always remains in such a region that the rear or trailing one-third portion thereof spreads or deposits flatly upon the ever so slightly curved end 15 of the guide straps 11, thereby ensuring that the sheet 6 lies flatly on the braking rollers 17 when the front or leading edge of the sheet is released by the gripper bridges 5. The braking rollers 17 are thereby able to brake the sheet 6 so strongly that the sheet 6 strikes against stops 19 provided at the front edge 18 of the delivery pile 24 at a reasonable or bearable speed. Damage to the front or leading edge, of sheet 6, or overlapping of the sheets when they are thin or the formation of creases or folds in the sheets 6 during braking is thereby obviated.

If the varying stiffness or rigidity of the sheets 6 that are to be processed is to be taken into consideration, then the possibility is to be taken into consideration, then the possibility also exists of replacing the guide straps 11 by narrow flexible bands or belts 20, the upper end of which is attached to a curved strap or bracket member 21 and the lower end of which to an adjustable guide segment 22. The strap member 21 is mounted so as to be laterally adjustable on the crosstie member 12, while the guide segment 22 is fastened so as to be laterally adjustable on an adjusting shaft 23 which is mounted in the side walls 14 of the sheet delivery and is rotatable by a non-illustrated hand wheel. The adjusting shaft 23 extends parallel to the rotary axis of the chain reversing or guide 3. Depending upon the position of the guide segment 22, the narrow bands or strips 20 form a sheet guide path in the form of a more or less flat sinusoidal curve.

Figure 4:
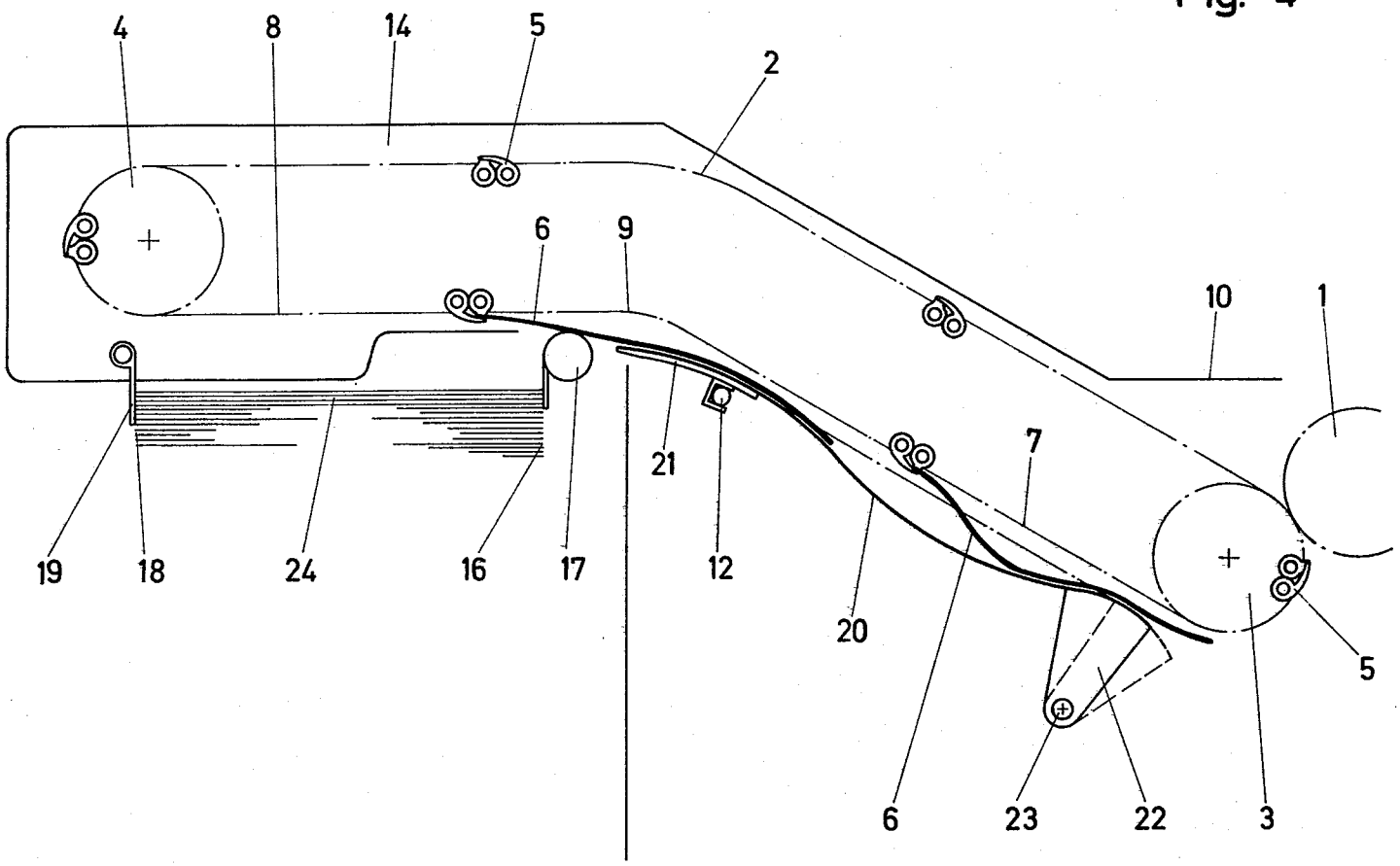
FIG. 4 is a view similar to that of FIG. 1 of another embodiment of the sheet delivery having adjustable bands.

When the sheet 6 is formed of stiff cardboard, the sheet guide path can extend virtually straightly. In such a case, the guide segment 22 is pivoted entirely toward the right-hand side in FIG. 4. When the sheet 6 is onion skin, on the other hand, a great degree of lateral stiffness or rigidity of the sheets 6 is necessary in order to prevent fluttering. Furthermore, light-weight sheets necessarily form a shorter wave because of the air resistance. Therefore, when thin sheets are being processed, the guide segment 22 is disposed entirely toward the left-hand side of FIG. 4 so that a deep wave trough is formed in the middle region of the ascending inclined straight section 7 of the chain path 2. The bands or belts 20 can also be adjusted so as to be in contact with unprinted areas of the sheet 6.

If, during perfector printing, practically no continuous unprinted areas are present on the underside of the sheet, it is then recommended, as shown in FIG. 5, to replace the curved guide straps 11 of FIGS. 1 to 3 by a corresponding number of rows of narrow guide wheels 25. As shown in FIGS. **6*a* and 6*b*, the guide wheels 25 may be in the form of thin discs 26 which are fastened on rotatably mounted axles 31, the supporting peripheral surface 27 of the discs 29 having toothing incised therein to reduce the contact area at the peripheral surface. The curved sheet guide path formed by the guide wheels 25 can be adjusted in the lateral direction so that the toothed peripheral surface 27 of the guide wheels 25 come in contact with only those areas of a sheet at which there is little cause to fear any reduction in the quality of the printing. Assurance is also afforded by the toothing and by the narrow width of the discs 26 that the freshly printed underside of the sheet is contacted only at a minimum number of locations. In order to permit the guide wheels 25 to be set in motion by the transported sheet without set-off or smearing, it is necessary to construct the axles 31** as thin i.e. with as small diameter, as possible so that a relatively high ratio of the axle diameter to the guide-wheel diameter can be attained.

For processing sheets that are printed on both sides thereof, a guide plate 28 extending across the entire width of the sheet delivery has been found to be particularly efficacious from the standpoint of sheet guidance without set-off or smearing. As is apparent from FIG. 7, this guide plate 28, like the guide straps 11 of FIGS. 1 to 3, must also be of arcuate construction and be spaced at a varying distance from the chain 2 in order to prevent fluttering of the end of the sheet 6. The guide plate 28, like the guide straps 11, is similarly fastened to the crosstie members 12 and 13. The rear or downstream edge 29 of the guide plate 28, as viewed in the direction of travel of the sheet 6, is provided with a curvature which is less than the curvature of the transition location 9 of the chain 2 between the straight ascending section 7 and the horizontally extending section 8 thereof. The front or upstream end 30 of the guide plate 28, as viewed in the travel direction of the sheet 6, partly surrounds the chain reversing or guide pulleys 3 and extends into the immediate proximity of the impressive cylinder 1. Considered in the sheet transport direction, namely from the right-hand to the left-hand side of FIG. 7 below the lower run of the endless chain 2, the front end 30 of the guide plate 28 also recedes spirally from the periphery of the chain reversing or guide pulleys 3.

This spiral-shaped construction of the front end 30 of the guide plate 28 ensures that the unprinted rear edge of the sheet 6 will come into contact with the top surface of the guide plate 28 the instant the rear edge of the sheet 6 is released from the surface of the impression cylinder 1, and will thus shove an air cushion in front thereof which reliably prevents the sheet 6 from laying the freshly printed underside thereof against the surface of the guide plate 28. The front end 30 of the guide plate 28 which recedes spirally from the periphery of the chain reversing or guide pulleys 3 prevents the sheet 6, which is guided around the latter, from striking against the edge of the guide plate 28 and also causes the formation of a strong air cushion which exerts an adequately supporting and guiding action upon the sheet 6 up to the top end i.e. at the left-hand side of FIG. 7, of the guide plate 29.

Due to the curvilinear configuration of the guide plate 28, an air pile-up or blockage occurs even at the outlet 32 of the wave trough between the sheet 6 drawn by the gripper bridges 5 and the guide plate surface tending to approach the chain 2. The air pile-up or blockage completely prevents the sheet 6 from breaking through to the surface of the guide plate 28 during the deflection or change of direction of the sheet 6 in the region of the slightly curved end 29. The conformation of the guide plate 28 according to the invention thus ensures that, immediately upon the arrival of a sheet accepted or taken over by the gripper bridges 5, a powerful air cushion will be produced, the sheet-supporting air pressure of which reaches a maximum at the change of direction or deflection of the sheet 6 from the ascending inclined path to the horizontal path followed thereby.

There are claimed:

1. Sheet delivery for rotary printing machines having gripper bridges carried by revolving endless chains traveling along a chain path having a straight and ascending section merging with a section of the path extending horizontally across a delivery pile, comprising means defining a sheet guide path having a curvilinear configuration spaced from end to end thereof at a continuously varying distance from the endless chains and disposed below the straight and ascending section of the chain path.

2. Sheet delivery according to claim 1 wherein the straight and ascending section and the horizontal section of the chain path merge at a transition location, and said sheet guide path has a generally rising section adjacent the straight and ascending section of the chain path, a generally horizontal section adjacent the horizontal section of the chain path, and a transition location between the generally straight and ascending and the generally horizontal sections of said sheet guide path, said transition location of said sheet guide path having a lesser curvature than that of the transition location of the chain path.

3. Sheet delivery according to claim 2 in combination with a rotary printing machine having at least one printing unit including an impression cylinder, wherein the revolving endless chains are looped about reversing pulleys at the lower end of the straight and ascending section of the chain path, the reversing pulleys being disposed adjacent the impression cylinder, said sheet guide path being in the form of a flat sinusoidal curve spaced closest to the endless chains at a first location in proximity of said chain reversing pulleys and at a second location adjacent the straight and ascending section of the chain path and close to the transition location at which the straight and ascending section and the horizontal section of the chain path merge.

4. Sheet delivery according to claim 3 wherein said means defining said sheet guide path are disposed transversely to and below said chain path and comprise a guide plate extending completely across the width of said sheet guide path.

5. Sheet delivery according to claim 4 wherein said guide plate has an end thereof partly surrounding the reversing pulleys and located in immediate proximity of a sheet transfer location between the impression cylinder and the respective gripper bridges carried by the endless chains, said end of said guide plate having a shape continuously receding from the periphery of the reversing pulleys.

6. Sheet delivery according to claim 5 wherein said end of said guide plate has a spirally widening shape.

7. Sheet delivery for rotary printing machines having at least one printing unit including an impression cylinder, and gripper bridges carried by revolving endless chains traveling along a chain path having a straight ascending section merging with a section of the path extending horizontally across a delivery pile, comprising means defining a sheet guide path having a curvilinear configuration spaced at a continuously varying distance from the endless chains and disposed below the straight and ascending section of the chain path, the straight and ascending section and the horizontal section of the chain path merging at a transition location, and said sheet guide path having a generally rising section adjacent the straight and ascending section of the chain path, a generally horizontal section adjacent the horizontal section of the chain path, and a transition location between the generally straight and ascending and the generally horizontal sections of said sheet guide path, said transition location of said sheet guide path having a lesser curvature than that of the transition location of the chain path, the revolving endless chains being looped about reversing pulleys at the lower end of the straight and ascending section of the chain path, the reversing pulleys being disposable adjacent the impression cylinder, said sheet guide path being in the form of a flat sinusoidal curve spaced closest to the endless chains at a first location in proximity of said chain reversing pulleys and at a second location adjacent the straight and ascending section of the chain path and close to the transition location at which the straight and ascending section and the horizontal section of the chain path merge, said means defining said sheet guide path comprising a plurality of flexible narrow bands disposed beneath the straight and ascending section of the chain path, a curved strap member located below and adjacent the transition location at which the straight and ascending section and the horizontal section of the chain path merge, and an adjustably pivotal guide segment mounted below and adjacent the reversing pulleys, one end of said narrow bands being secured to said strap member and the other end thereof to said pivotal guide segment.

* * * * *